United States Patent [19]

Leonov et al.

[11] 4,408,726

[45] Oct. 11, 1983

[54] ORTHOCYCLIC COIL WINDING MACHINE

[76] Inventors: Ivan A. Leonov, Bezbozhny pereulok, 3, kv. 31; Boris V. Smirnov, Chusovskaya ulitsa, 10, korpus 1, kv. 17; Vladimir V. Mashinin, Igralnaya ulitsa, 10, kv. 220; Viktor I. Sharovatov, ulitsa Burakova, 11, korpus 1, kv. 35, all of Moscow, U.S.S.R.

[21] Appl. No.: 249,481

[22] Filed: Mar. 31, 1981

[51] Int. Cl.[3] ..... H01F 41/06

[52] U.S. Cl. ..... 242/7.09; 140/92.1; 242/7.16; 242/158 R

[58] Field of Search ..... 242/7.09, 7.13, 7.14, 242/7.15, 7.16, 72.1, 110.1, 110.2, 158 R; 140/92.1

[56] References Cited

U.S. PATENT DOCUMENTS

| | | | |
|---|---|---|---|
| 3,128,956 | 4/1964 | Schümann | 242/7.09 |
| 3,136,493 | 6/1964 | Swanson | 242/7.09 |
| 3,237,875 | 3/1966 | Van der Hoek et al. | 242/7.13 |
| 3,552,673 | 1/1971 | Evers | 242/72.1 |
| 3,578,034 | 5/1971 | Eminger | 242/7.09 |
| 4,046,175 | 9/1977 | Gardner et al. | 140/92.1 |

FOREIGN PATENT DOCUMENTS

| | | | |
|---|---|---|---|
| 1232655 | 7/1967 | Fed. Rep. of Germany . | |
| 1489778 | 3/1978 | Fed. Rep. of Germany | 242/7.09 |

OTHER PUBLICATIONS

*Change Speed Smoothly,* "Engineering For The Youth", by Nurbei Gulia, Moscow, Nov. 12, 1977.

*Semiconductor Integrated Microcircuits, Series K 511,* ENIMS, Moscow 1978, pp. 72, 76, 108.

*Primary Examiner*—Billy S. Taylor

*Attorney, Agent, or Firm*—Burgess, Ryan & Wayne

[57] ABSTRACT

An orthocyclic coil winding machine comprises a bed on which is mounted a turntable with several mandrels installed radially thereon, each of the mandrels comprising a body whereon is mounted a tapered supporting sleeve. Installed on the supporting sleeve are a slotted head flange, a removable tail flange and a carrier with radial slots wherein are installed sectors having tapers on one side and teeth on the opposite side, the teeth forming grooves therebetween. Elastic rings are fitted on the sectors. The bed of the machine mounts a spindle with a faceplate. The faceplate mounts a wire placer which acts as a wire tensioner in addition to its major function of placing wire. Provision is made of a winding pitch correction controller which is mechanically and inductively connected with the winding spindle.

3 Claims, 16 Drawing Figures

ORTHOCYCLIC COIL WINDING MACHINE

TECHNICAL FIELD

This invention relates to manufacturing equipment for making electric coil windings and has particular reference to machines for winding orthocyclic electric coils.

The invention may be used in various applications, for example, in electric engineering and in manufacture of automotive and aviation electrical and electronic equipment.

Background Art

There is known a machine for winding orthocyclic coils (F.R.G. Pat. No. 1232655, cl. H 01 F, 1961).

The known machine comprises a bed and a turntable with several mandrels radially installed thereon. Located at the required distance from one of the mandrels is a winding spindle installed on the machine bed and provided with a drive unit. Mounted on the spindle is a faceplate whose shaft carries a wire placer. As the turntable rotates in the proper sequence, the mandrels are set in the required position at the winding spindle. The winding spindle rotates and reciprocates simultaneously. This winding spindle is constructed as a hollow shaft through which wire passes from an uncoiler to a winding head.

When the coil has been wound with the required number of turns, a counter mechanism switches off the winding spindle drive. The winding spindle is braked and thereafter, by means of an auxiliary drive, a worm gear and a freewheel clutch, is slowly turned into the initial position whereat guide pulleys, which are mounted on the faceplate of the winding spindle, are over the completed coil. When this position has been attained, the auxiliary drive is switched off by a contact. Thereafter the drive of the winding spindle is switched on again and winding is done on the next coil.

The known machine can wind only former coils because of the mandrel construction. This machine fails to ensure high quality of winding multilayer coils, especially with fine wire, because of lack of uniform winding pitch inasmuch as said machine has no provision for pitch correction in winding orthocyclic coils.

SUMMARY OF THE INVENTION

It is an object of the present invention to provide an orthocyclic coil winding machine that will ensure high-quality winding of former and formerless coils.

It is another object of the present invention to provide an orthocyclic coil winding machine that will ensure high-quality winding of coils with finer wire.

It is still another object of the present invention to provide an orthocyclic coil winding machine that will ensure uniform wire turn pitch in multilayer coils at the commencement of winding.

The invention provides an orthocyclic coil winding machine comprising a bed on which is mounted a turntable with several mandrels installed radially thereon, and further comprises a winding spindle with a drive union, and a faceplate mounted on the winding spindle and having a shaft whereon is mounted a wire placer, according to the invention, each mandrel is constructed in the form of a body whereon is mounted a tapered supporting sleeve on which are installed a slotted head flange, a removable tail flange, and a carrier with radial slots wherein are movably installed sectors having elastic rings installed thereon, the tapers of the sectors mating with the taper of the supporting sleeve, and the sector sides opposite the respective tapers being provided with teeth which form grooves.

It is desirable that, in order to provide for self-placement of wire at the preset pitch of the winding spindle during the movement thereof along the mandrel axis, the wire placer should be constructed as a guide pulley and a tensioner comprising a rotatable sleeve having longitudinal slots and installed on the shaft of the guide pulley and further comprising a brake installed on the rotatable sleeve and arranged to contact the guide pulley, the guide pulley with the rotatable sleeve installed thereon being positioned between abutments with a clearance equal to the diameter of the wire being wound.

It is further desirable that, in order to maintain the winding pitch within the preset limits, the machine should be provided with a winding pitch correction controller comprising a correction unit mechanically linked with the winding spindle and an actuator whose electrical input connects with an amplifier which is connected with coil fill pickup installed on the machine bed and mechanically linked with the winding spindle and is also connected with a wire turn count pickup mounted on the machine bed and arranged to interact with the winding spindle.

The proposed invention widens the scope of the machine by virtue of the special mandrel construction which enables formerless coils to be wound as well as former coils. The invention enhances the quality of coil manufacture inasmuch as it provides for producing orthocyclic coils with more turns and layers.

BRIEF DESCRIPTION OF THE DRAWINGS

The invention will now be more particularly described by way of example with reference to the accompanying drawings, wherein.

DETAILED DESCRIPTION OF THE INVENTION

Figure 1:
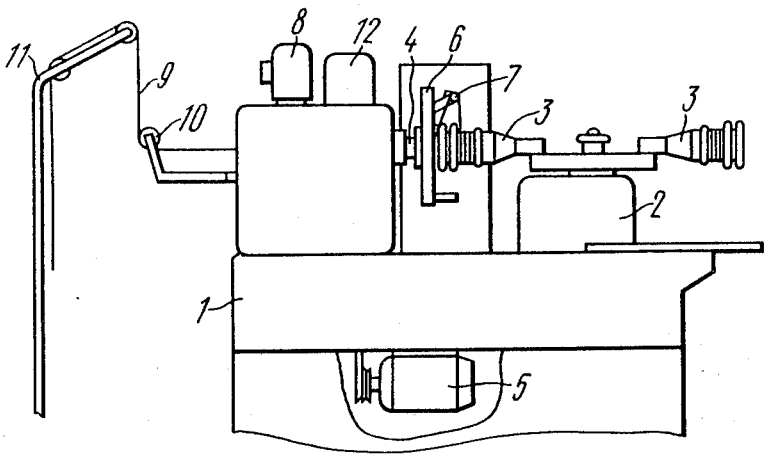
FIG. 1 is a general side view of an orthocyclic coil winding machine according to the invention.

The orthocyclic coil winding machine comprises a bed 1 (FIG. 1) which mounts a turntable 2 with several mandrels 3 installed radially thereon. At the required distance from one of the mandrels 3 is situated a winding spindle 4 driven by a drive unit 5.

The winding spindle 4 mounts a faceplate 6 on whose shaft is installed a wire placer 7.

An electric motor 8 is provided for setting the faceplate 6 in the initial position.

The winding spindle 4 has a hollow shaft through which is fed wire 9 running from an unreeling device 11 by way of a guide pulley 10.

Figure 2:
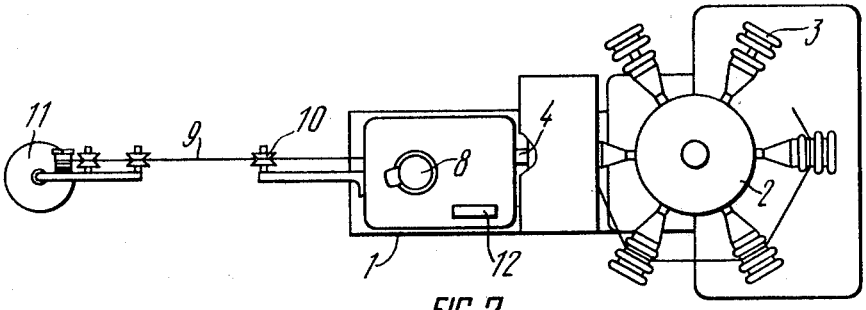
FIG. 2 is a general plan view of an orthocyclic coil winding machine according to the invention.

A coil fill pickup 12 (FIG. 2), designed for control of filling coil tiers with wire turns, is provided on the bed 1.

The mandrel 3 is constructed as a body 13 (FIG. 3) with a tapered supporting sleeve 14 mounted thereon. The supporting sleeve 14 mounts a head flange 15 with a slot, a removable tail flange 16, and a carrier 17 with radial slots 18 wherein sectors 19 are installed for radial movement. The tapered surface of the sectors 19 mates with the tapered surface of the supporting sleeve 14. On the side opposite the tapered surface, the sectors 19 are provided with teeth 20 which form grooves 21. Elastic rings 22 are provided on the sectors 19. A rod 23 is inserted into the hole in the supporting sleeve 14. Locks 24 are provided on the mandrel body 13 for the purpose of fixing the rod 23 in the supporting sleeve 14.

Figure 3:
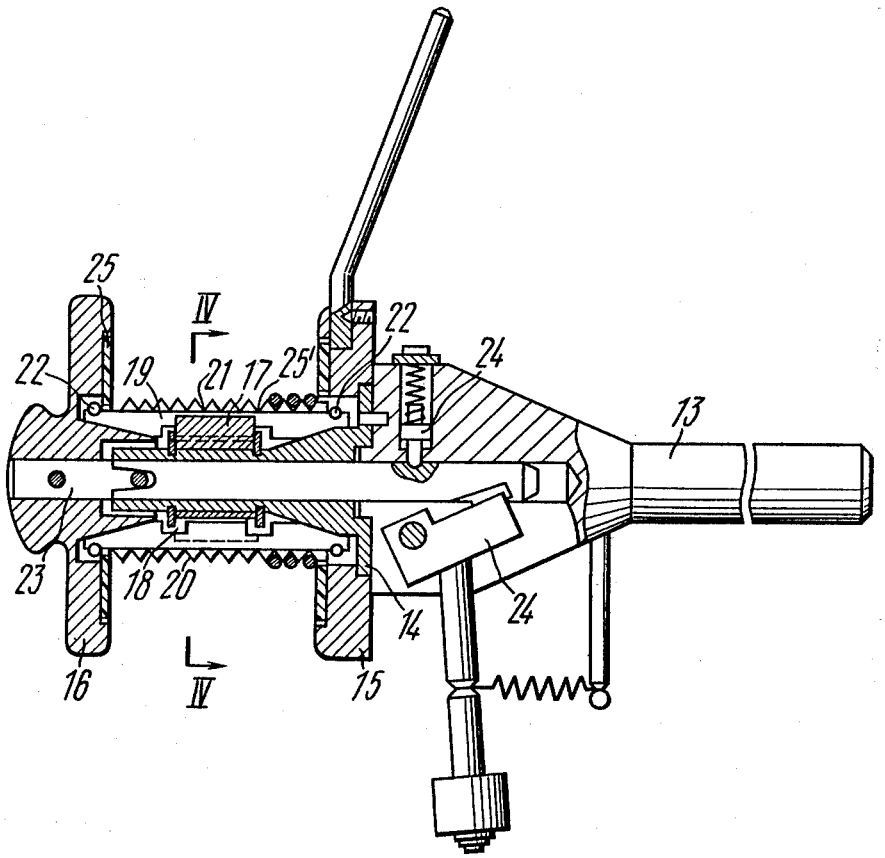
FIG. 3 is a longitudinal sectional view of a mandrel according to the invention.

FIG. 3 depicts a mandrel 3 which mounts a coil form having flanges 25 and a body 25' with longitudinal slots.

Figure 4:
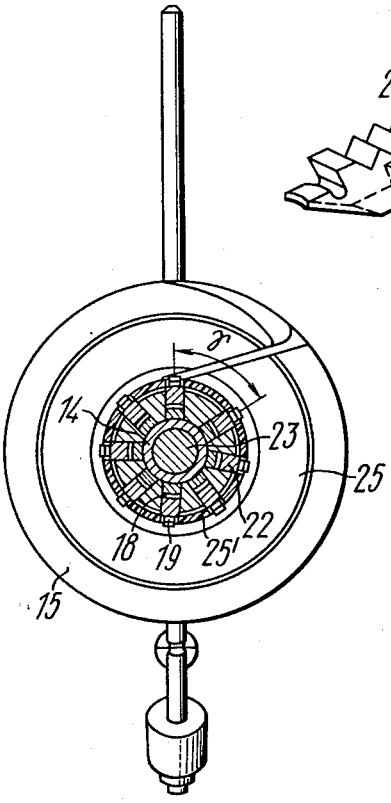
FIG. 4 is a cross sectional view of FIG. 3 according to the invention.

To enable wire transition from turn to turn (zone $\gamma$ in FIG. 4), the space between the two sectors 19 at the location of the slot in the flange 15 may be wider than between the other sectors.

Figure 5:
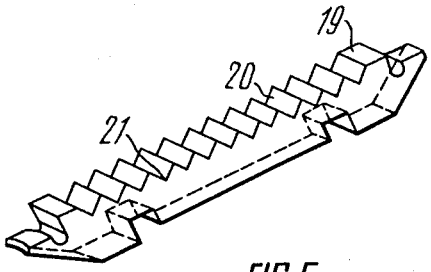
FIG. 5 shows the construction of a sector according to the invention.

FIG. 5 shows the construction of a sector 19 with teeth 20 and grooves 21.

The wire placer 7 comprises a guide pulley 26 (FIG. 6) and a tensioner constructed in the form of a rotatable sleeve 27 which has longitudinal slots 28 and is installed on the shaft 29 of the guide pulley 26, and further comprising a brake 30 which is installed on the rotatable sleeve 27 and is arranged to contact the guide pulley 26. The guide pulley 26 with the rotatable sleeve 27 installed thereon is positioned between abutments 31 and 32 with a clearance t equal to the diameter of the wire 9 being wound.

Figure 6:
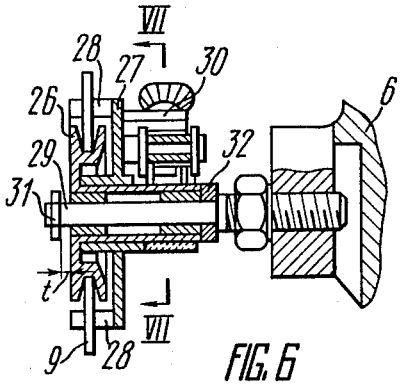
FIG. 6 is a longitudinal sectional view of a wire placer according to the invention.
Figure 7:
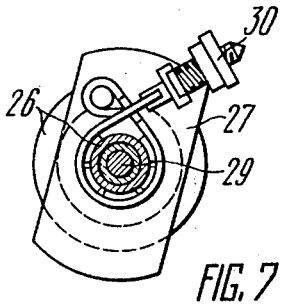
FIG. 7 is a sectional view on the line VII—VII of FIG. 6 according to the invention.
Figure 8:
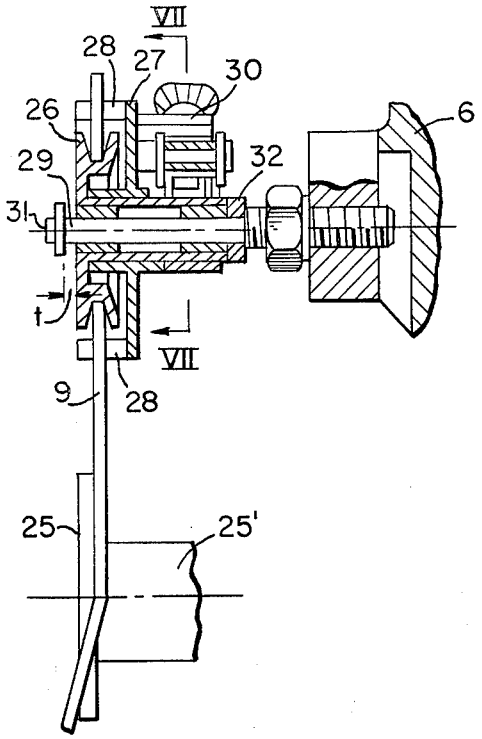
FIGS. 8, 9, 10 and 11 schematically show a wire placer and a mandrel and explain the successive stages of forming the first wire turn in winding an orthocyclic coil according to the invention.
Figure 9:
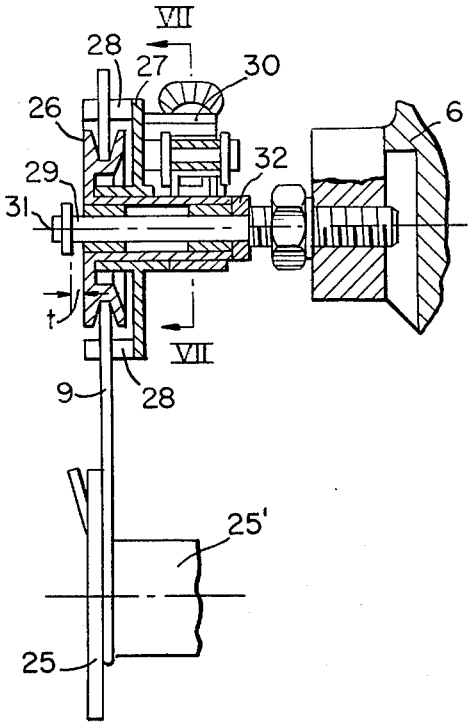
Figure 10:
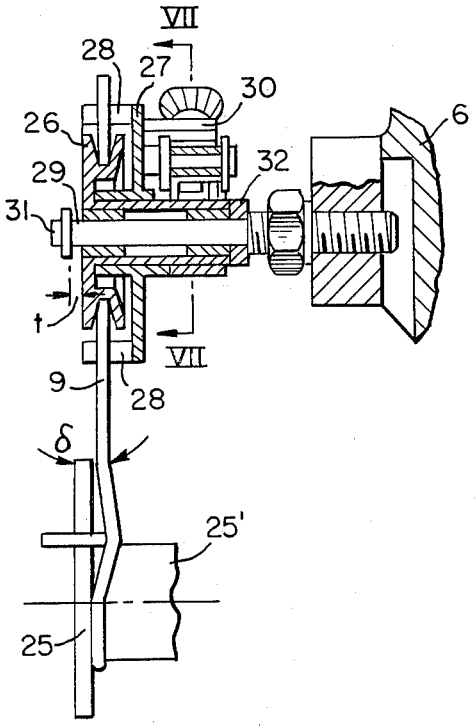
Figure 11:
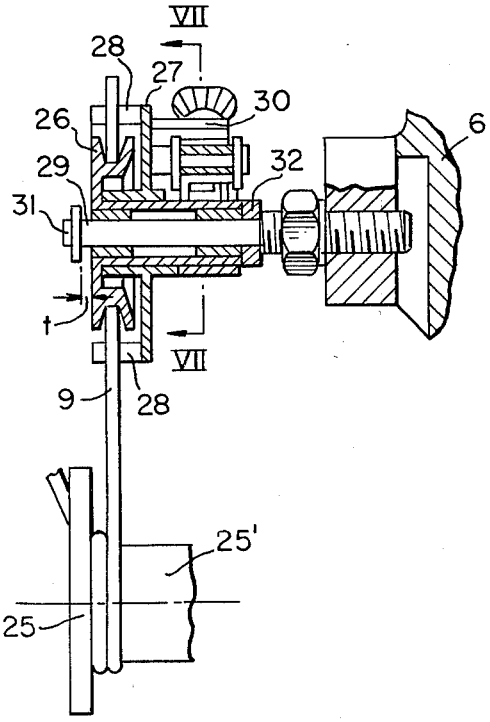

FIG. 7 is a sectional view on the line VII—VII of FIG. 6 according to the invention.

FIGS. 8, 9, 10 and 11 schematically depict the wire placer and a mandrel and explain the successive stages of forming the first wire turn in winding an orthocyclic coil.

Figure 12:
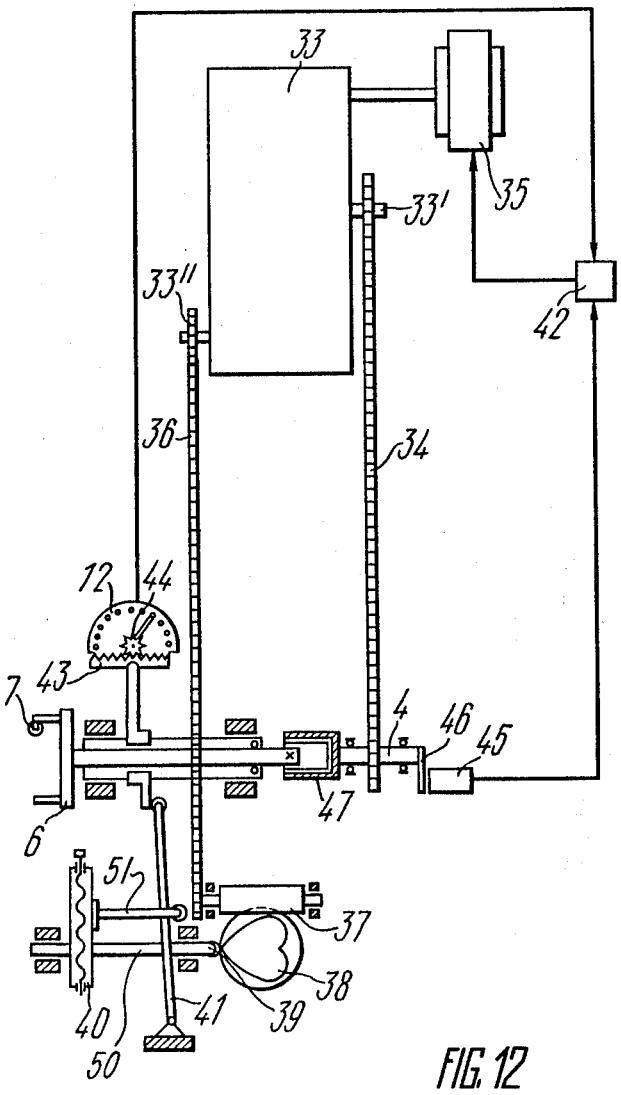
FIG. 12 is a diagrammatic view of an orthocyclic winding pitch correction controller according to the invention.
Figure 12A:
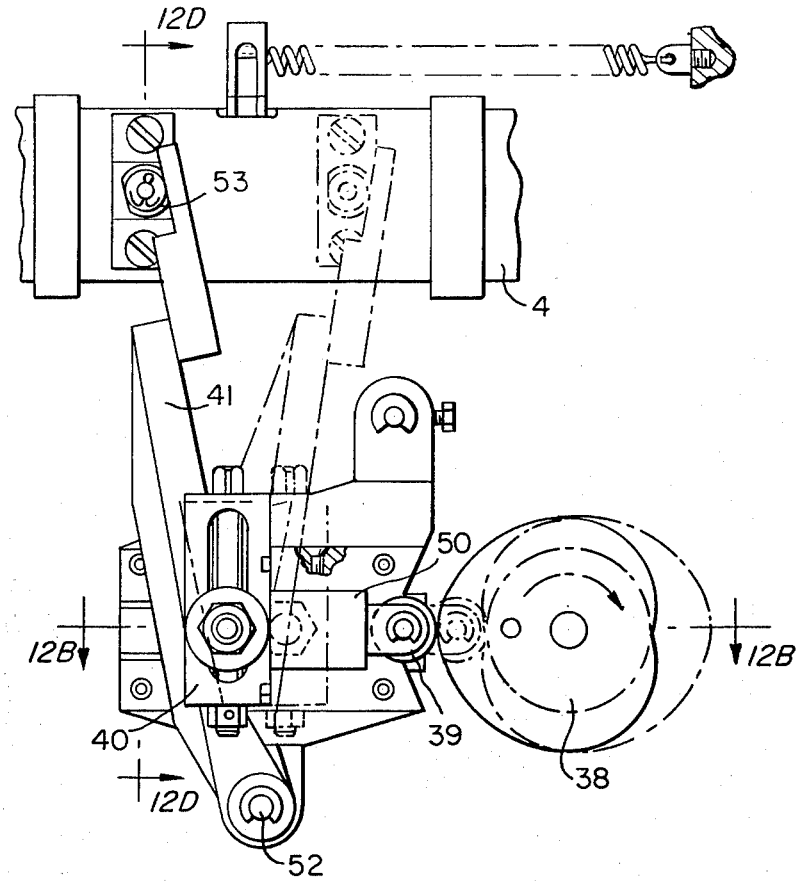
FIG. 12A is a front elevation of a part of the correction controller of FIG. 12.
Figure 12B:
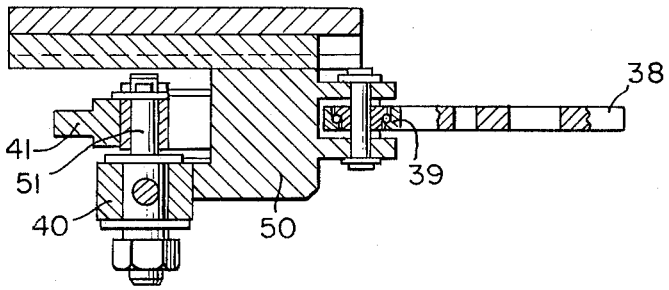
FIG. 12B is a cross-section taken on the line A—A of FIG. 12A.
Figure 12C:
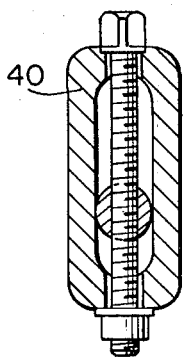
FIG. 12C is a cross-section taken on the line B—B of FIG. 12D.
Figure 12D:
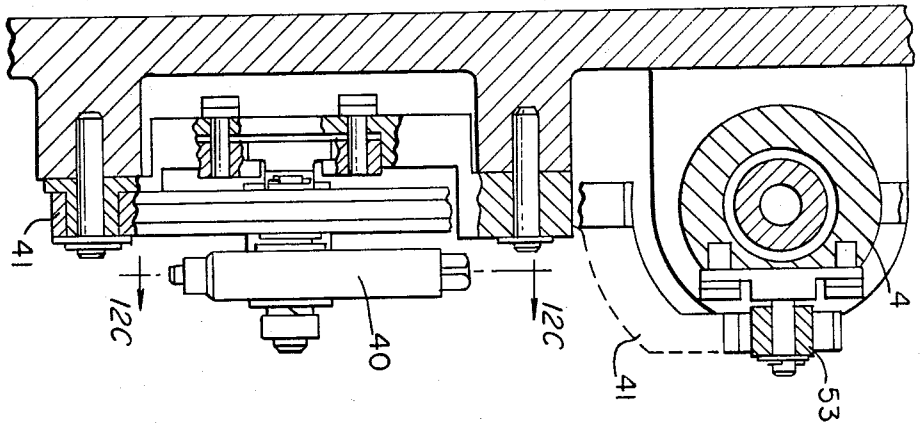
FIG. 12D is a cross-section taken on the line C—C of FIG. 12A.

Correction of the pitch in winding an orthocyclic coil is effected by the use of a winding pitch correction controller comprising a correction unit 33 (FIG. 12) constructed, for example, as a variable-speed drive (see the magazine "Engineering for the Youth" No 12, 1977, Moscow, an article by Nurbei Gulia "Change Speed Smoothly or Variations on the Theme of Variable-Speed Drives) which is provided with an actuating mechanism 35 constructed, for example, as an electric motor correction unit 33 has an input shaft 33' and an output shaft 33'', and is mechanically linked through a flat-toothed belt 34 with the winding spindle 4 and through suitable means 36 with a worm wheel drive 37. The shaft of the worm wheel mounts a cam 38 which mates with a follower roller 39 installed on a slide 50 which is rigidly connected to a screw mechanism 40 which engages, through a pusher 51, a pivoted lever 41 which engages the spindle 4. The electrical input of the actuating mechanism is connected with the output of an amplifier 42 (see "Semiconductor Integrated Microcircuits, Series K511), for Machine-tool Control Systems", published by ENIMS, Moscow, 1978, pages 72,76,108).

The amplifier 42 is electrically connected with the coil fill pickup 12, which is constructed, for example, as a wiper switch installed on the bed of the winding machine and mechanically linked with the winding spindle 4 through a rack 43 and a pinion 44. The amplifier 42 is also electrically connected with a wire turn count pickup 45 constructed, for example, as a contactless limit switch. A finger 46 connected with the spindle 4 is caused by the spindle movement to act upon the pickup 45. To enable lengthwise movement of the spindle 4, the latter is made in two parts united by means of a splined coupling 47.

When the winding machine is put in operation, the turntable 2 (FIG. 1) with several mandrels 3 is moved by a pitch determined by the quantity of the mandrels 3 and thereafter the turn-table is locked in position. Then the drive unit 5 is switched on and rotation is transmitted to the winding spindle 4. The winding spindle 4, in conjunction with the faceplate 6 and the wire placer 7, places the wire 9 in the winding space of the mandrel 3. When the last wire turn is completed, the spindle 4 operates a limit switch (not shown), whereby the drive unit 5 is switched off. The spindle 4 is positively braked and at the same time the motor 8 is switched on to set the faceplate 6 into the initial position.

The mandrel 3 (FIG. 3) operates as follows:

The coil former with the flanges 25 is mounted on the mandrel 3. Thereafter the removable tapered tail head flange 16 is installed. By interaction of the tapers of the flange 16 and of the supporting sleeve 14 with the tapers of the toothed sectors 19 fitted in the slots 18 provided in the carrier 17, the sectors 19 are moved radially toward the former body 25' and the sector teeth 20 enter the lengthwise slots in the former body 25', standing over the surface thereof. The sectors 19 are locked in position by the locks 24. The teeth 20 of the sectors 19 form orthocyclic grooves 21.

After the coil has been wound, the tapered flange 16 is removed, the sectors 19 are returned into the initial position by the action of the elastic rings 22, the teeth 20 come out of the slots in the former body 25', and the completed coil is removed from the mandrel 3.

The winding of an orthocyclic coil can also be done without a former. In such a case the mandrel 3 functions likewise, but a former is not used and the flanges 25 are replaced with dummies.

In the making of orthocyclic coils, the proposed mandrels enable effecting economy in the material of formers, provide a choice of winding technology (with or without formers) and promote flexibility of the control and organization of coil manufacture.

The wire placer 7 operates as follows:

The wire 9 (FIG. 1) passes from the unreeling device 11 through the guide pulley 10 and the hollow shaft of the spindle 4 to the wire placer 7.

Before the commencement of winding, tension is given to the wire 9, between the pulley 26 and the winding, by means of the sleeve 27 (FIG. 6) and the brake 30 mounted thereon. The initial position of the pulley 26 is set so that the axis of the wire 9 makes a right angle with the axis of the coil former or of the mandrel 3, the wire 9 contacting the flange 25 (FIG. 3) of the coil former. In this case the pulley 26 (FIG. 6) contacts the abutment 31 installed on the shaft 29. A clearance t equal to the maximum diameter of the wire 9 is provided between the pulley 26 and the abutment 31.

With the machine switched on, the spindle 4 (FIG. 1) rotates and moves along the axis of the mandrel 3, causing movement of the shaft 29 (FIG. 6). This starts the process of forming a wire turn in the plane perpendicular to the axis of the coil former, i.e. as the shaft 29 moves together with the spindle 4 (FIG. 1) in the direction of the wire turn placement, the pulley 26 (FIG. 6) remains in place under the action of wire tension or oscillates a little along the axis of the shaft 29. After the wire placer 7 rotates about the wire approximately through 360°, the wire 9 (FIG. 10) starts forming a second turn.

At the commencement of forming the second turn the portion of the wire 9 between the winding and the pulley 26 makes an angle $\delta$ with the vertical, owing to which rise is given to an axial component acting in the direction of movement of the shaft 29. By the action of this force the pulley 26 moves on the shaft 29 in the direction of the wire turn placement and takes a position similar to the position of the pulley 26 (FIG. 11) at the commencement of winding the first turn. The shaft 29 with the abutments 31 and 32 moves so that at the commencement of forming the first turn of the second layer the abutment 31 ensures that the portion of the wire 9 between the winding and the pulley 29 is perpendicular to the axis of the coil former.

At this instant the shaft 29 starts to be positively moved in the opposite direction and therefore the axial movement of the pulley 26 and of the sleeve 27 mounted thereon is limited by the abutment 32. Now the process of forming the turns of the second tier commences and the operation proceeds in this manner until the coil former is filled up with wire turns.

The wire placer 7 (FIG. 1), apart from its major function of placing wire, acts as a wire tensioner. The tension of the wire 9 (FIG. 6) on the pulley 26 is created by virtue of the wire 9 rubbing against the slots 28 of the sleeve 27 and the action of the brake 30 on the pulley 26 which controls the braking moment of the pulley 26 and, accordingly, the tension of the wire 9 which is wound around the pulley. The slots 28 prevent the sleeve from rotation with respect to the pulley 26.

The pulley 26 together with the sleeve 27 and the brake 30 moves relative to the shaft 29 in the direction of the wire turn placement. The abutments 31 and 32 installed on the shaft limit the free movement of the pulley 29 within the clearance t equal to the diameter of the wire 9, which is particularly necessary for excluding the influence of the dynamic components in transition from turn to turn and at the instant of reversal of the direction of the wire turn placement. The clearance t between the abutments 31, 32 and the pulley 26, which is equal to the diameter of the wire 9, and the positive movement of the shaft 29 in winding one turn ensure the process of self-placement of the wire 9 strictly for each turn. With the aid of the abutments 31 and 32 the pulley 26 is set in the initial position before winding the coil. The combination of the wire placement and tension functions in one mechanism simplifies the machine and ensures high-quality placement of the wire. The combination of the principle of positive wire placement in a tier with self-placement of the wire in a turn enhances the quality of wire placement by virtue of reducing the influence of inertia forces and vibration. There is no need of special devices for damping vibration in winding coils at high speed with a considerable winding aperture. This wire placer features a great advantage in that it can be used in modern high-production winding machines of the rotary type, wherein the coil is stationary and the wire placer rotates. The use of such a machine for winding orthocyclic coils increases 2–2.5 times the productivity of the coil winding process. The use of the orthocyclic coil winding machine provides for enhancing the winding closeness and economizing up to 6 percent of wire.

In the proposed orthocyclic coil winding machine, correction of the winding pitch is accomplished as follows:

With the machine switched on, the spindle 4, (FIG. 12) rotates, acting on the count pickup 45 and the turn fill pickup 12. The signals from the pickup 45 give information on the wound turn, whereas the signals from the pickup 12 give information on the travel of the wire placer 7 through the pitch in winding the turn. These signals are fed into the amplifier 42, wherein they are processed and amplified. The amplified signal is sent to the actuating mechanism 35 which operates the correction unit 33 designed to vary the pitch of coil winding.

From the spindle 4 rotation is transmitted by the flat-toothed belt 34 to the input shaft 33' of the correction unit 33. From the input shaft 33' of the correction unit 33 rotation is transmitted to the output shaft 33'', thence, via the means 36, to the worm wheel drive 37 and therefrom to the cam 38. This cam operates a lengthwise placement mechanism and moves the lever 41 which is pivoted to the housing at 52 whereas the other end thereof mates with the abutment 53 of the spindle 4. Thus the spindle 4 with the faceplate 6 and the wire placer 7 makes rotary and reciprocating movements and the wire placer 7 places the wire 9 (FIG. 1) in the winding space of the mandrel 3.

If the signals from the pickup 45 (FIG. 12) and the pickup 12 come to the amplifier 42 simultaneously, the winding pitch need not be corrected and therefore the actuator 42 does not send a signal to the actuating mechanism 35.

If the signal from the pickup 45 comes later than the signal from the pickup 12, the amplifier 42 sends a signal to the actuating mechanism 35 and the latter operates the correction unit 33. The correction unit 33 slows down the worm wheel drive 37 through the operation of the output shaft 33'' and the flat-toothed belt 36. The worm wheel drive 37 transmits the slower rotation to the cam 38 which mates with the roller 39 of the slide and operates, through the screw mechanism 40, the pivoted lever 41 and the spindle 4. The pivoted lever 41 transmits a slower reciprocating movement to the spindle 4, whereby the winding pitch is decreased. The correction of the winding pitch is effected until the signals from the pickups 45 and 12 come to the amplifier 42 simultaneously.

If the signal from the pickup 45 comes earlier than the signal from the pickup 12, the amplifier 42 sends a signal to the actuating mechanism 35 which operates the correction unit 33 through a rigid link. The correction unit 33 speeds up the worm wheel drive through the operation of the output shaft 33'' and the means 36. The worm wheel drive 37 transmits the faster rotation to the shaft of the cam 38 which mates with the roller 39 of the slide and operates, through the screw mechanism 40, the pivoted lever 41 and the spindle 4. The pivoted lever 41 transmits a faster reciprocating movement to the spindle 4, whereby the winding pitch is increased. The correction of the winding pitch is effected until the signals from the pickups 45 and 12 come to the amplifier 42 simultaneously.

The employment of the proposed winding pitch correction controller provides for fuller and wider use of rotary winding equipment in the manufacture of windings.

The invention provides for simplifying the construction of the machine, increasing its working rate and enhancing the quality of orthocyclic windings.

What is claimed is:

1. An orthocyclic coil winding machine comprising:

a bed;

a turntable mounted on said bed;

a plurality of mandrels installed radially on said turntable;

each of said mandrels comprising:

a body;

a tapered supporting sleeve installed on said body;

a slotted head flange;

a removable tail flange;

a carrier with radial slots therein;

said head flange, removable tail flange and carrier with radial slots being installed on said supporting sleeve;

sectors which are tapered downwardly and inwardly from the ends on the inner surface thereof and have teeth forming grooves on the outer surface thereof;

elastic retaining rings installed on said sectors;

said sectors being radially movable installed in said radial slots of said carrier;

said tapered surfaces of said sectors mating with said tapered supporting sleeve;

a winding spindle coaxial with one of said mandrels, and a drive unit therefor;

a faceplate fixed to said winding spindle at the end proximate said one mandrel;

a shaft mounted on said faceplate at a location radially outward of the axis thereof;

said winding spindle being spaced apart from said one of said mandrels;

wire placer means mounted on the shaft of said faceplate in an overlying relationship with said one mandrel.

2. A machine as claimed in claim 1, wherein, in order to provide for self-placement of the wire at the preset pitch of the winding spindle during the movement thereof along the mandrel axis, said wire placer comprises:

a guide pulley having a shaft, the wire being wound around said pulley and guided thereby;

a rotatable sleeve having longitudinal slots and installed on the shaft of said guide pulley;

a brake arranged to contact said guide pulley and mounted on said rotatable sleeve;

said rotatable sleeve and said brake constituting a tensioner;

abutments fixed to said guide pulley shaft;

said guide pulley with said rotatable sleeve installed thereon being positioned between said abutments with a clearance equal to the diameter of the wire being wound.

3. A machine as claimed in claim 1 or 2, which, in order to maintain the winding pitch within the preset limits, comprises a winding pitch correction controller including:

a correction unit mechanically linked with said winding spindle;

an actuating mechanism for said correction unit, and an electrical input for said actuating mechanism;

an amplifier having a first and a second input and an output;

a coil fill pickup installed on said bed of the machine and mechanically linked with said winding spindle;

a wire turn count pickup installed on said bed of the machine and arranged to interact with said winding spindle;

said electrical input of said actuating mechanism being connected with said output of said amplifier;

said first input of said amplifier being connected with said coil fill pickup;

said second input of said amplifier being connected with said wire turn count pickup.

* * * * *